United States Patent [19]

Tirtoprodjo et al.

[11] Patent Number: 4,804,437

[45] Date of Patent: Feb. 14, 1989

[54] TAPE DISPENSER

[76] Inventors: Santono Tirtoprodjo, 633 Dory La., Redwood City, Calif. 94065; Ming H. Leong, 16435 Mozart Way, Los Gatos, Calif. 95030

[21] Appl. No.: 95,289

[22] Filed: Sep. 10, 1987

[51] Int. Cl.[4] ..... B32B 31/04; B32B 35/00

[52] U.S. Cl. ..... 156/577; 156/523; 156/579

[58] Field of Search ..... 156/523, 577, 527, 576, 156/579

[56] References Cited

U.S. PATENT DOCUMENTS

| | | | |
|---|---|---|---|
| 3,850,779 | 11/1974 | Pearson | 156/577 |
| 4,097,328 | 6/1978 | Urushizaki | 156/523 |
| 4,238,271 | 12/1980 | Urushizaki | 156/523 |
| 4,486,263 | 12/1984 | Gomez | 156/523 |

*Primary Examiner*—Michael Wityshyn

*Attorney, Agent, or Firm*—Townsend and Townsend

[57] ABSTRACT

An improved tape dispenser which is less likely to jam and which has a blade shield to prevent injury. Centrally of the dispenser there is placed a roll of tape conventionally wound in a spiral. The roll of tape has an outwardly exposed adhesive release surface and an inwardly exposed adhesive coated surface. In the dispenser, the tape is threaded on a dispensing path towards a cutting blade. Typically, the path is defined by a combination of guides terminating with a roller. The roll and the dispensing path are encased within a housing to prevent the exposed adhesive from adhering either to dust or nearby objects. The tape path extends past a severing tape blade. The trigger motion of the handle acts to pivot the tape holder on its hinge and move the severing blade holder. The motion of the tape holder is restricted by a guide, a guide slot and a stop. When the tape holder is in its original position, a blade shield keeps the blade from being exposed.

3 Claims, 3 Drawing Sheets

TAPE DISPENSER

BACKGROUND OF THE INVENTION

1. Field of the Invention

This invention relates generally to a tape dispenser and specifically to tape dispensers having trigger devices and tape severing means. This invention has a practical application in any situation where adhesive backed tape is employed.

There is a need to dispense tape readily and easily. Several devices are known for such dispensing. These devices commonly have a trigger mechanism which expels a short length of the end of the tape roll outside of the dispenser. The part of the dispenser which guides the tape is readily susceptible to jamming on the housing of the dispenser and the angle of application is often critical. Many trigger actuated dispensers commonly provide a blade to cut the tape. Such blades are generally exposed or in an unshielded state when in operation such that injury may result. There is therefore a need for a trigger actuated tape dispenser having a non-critical angle of application that will not jam. Further, where a cutting edge is provided, there is a need for a shielding means to prevent injury.

2. Description of the Relevant Literature

U.S. Pat. No. 2,636,691 discloses a device for dispensing pressure sensitive adhesive tape having reciprocative guide means for directing the starting length of tape into a predetermined position;

U.S. Pat. No. 3,374,139 discloses a tape dispenser having a hand brake;

U.S. Pat. No. 3,539,418 discloses a single handed tape dispenser;

U.S. Pat. No. 3,674,609 discloses labeling devices similar in construction to other prior art tape dispensers;

U.S. Pat. No. 3,785,901 discloses a hand operable tape dispenser and applicator;

U.S. Pat. No. 3,850,779 discloses a tape dispenser having a pressure actuated guard;

U.S. Pat. No. 3,951,726 discloses a device for stripping, dispensing and applying adhesive tape;

U.S. Pat. No. 3,969,181 discloses a device for dispensing transfer adhesive;

U.S. Pat. No. 3,969,180 discloses a device laying down a tape strip;

U.S. Pat. No. 4,196,028 discloses a device for taping joints in wallboard;

U.S. Pat. No. 4,253,905 discloses a tape dispenser having a pivotal cutter edge; and U.S. Pat. No. 4,511,427 discloses a masking tape dispenser.

Perhaps the most common type of tape dispenser is one in which adhesive backed tape is dispensed from a roll with the adhesive coated side inwardly exposed and an adhesive release surface outwardly exposed. The tape roll is held in a frame and the tape is threaded to the vicinity of a serrated knife. A short ledge near the serrated knife allows the tape to be held in the vicinity of the knife.

Another common device has a trigger disposed in the top of the dispenser opposite the tape dispensing roller. Actuation of the trigger disposes the dispensing roller outward from the case, and revealing the starting length of tape.

SUMMARY OF THE INVENTION

The present invention improves on the prior art by providing a means by which the movement of the tape holder may be restricted so that the tape holder does not jam and the angle of application is not critical. The present invention includes a guide attached to the case, which works in combination with a guide slot in the tape holder. In addition, a stop which is attached to the case of the dispenser restricts the downward motion of the tape holder. Both of these improvements work to keep the tape holder from jamming on the case of the tape dispenser. Further, the present invention improves on the prior art by providing shield means to prevent injury from a tape cutting edge. The shield keeps the blade covered in order to prevent injury while the tape dispenser is not in use or when the roll of tape is being changed.

DESCRIPTION OF THE SPECIFIC EMBODIMENTS

Figure 1:
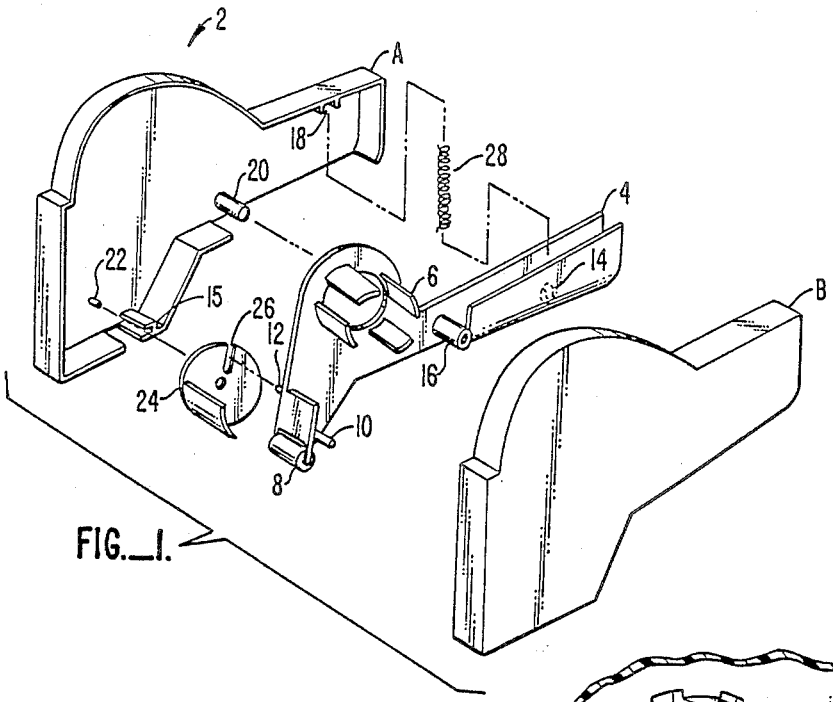
FIG. 1 is an exploded view of a tape dispenser according to the subject invention.

Referring to FIG. 1, case 2 comprises two parts A and B which enclose trigger assembly 4. Trigger assembly 4 includes tape hub 6, contact roller 8, tape guide 10, cutting edge pin 12, spring retaining pin 14, and sleeve 16. Case part A includes cutting edge shield 15, spring channel 18, trigger hub 20, and cutting edge hub 22.

Case 2 is assembled by placing a roll of adhesive backed tape on hub 6 and placing cutting edge assembly 24 on hub 22 and then placing sleeve 16 on trigger hub 20 while taking care to align pin 12 with channel 26. Spring 28 is placed on retaining pin 14 and aligned in channel 18. The tape is then threaded from hub 6 past pin 10 and slightly beyond roller 8 with the adhesive release surface facing the roller. Case part B is assembled together with part A to complete case 2 and the dispenser is ready for use.

Figure 2:
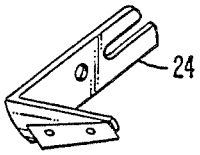
FIG. 2 is a detailed view of a tape cutting edge.
Figure 3:
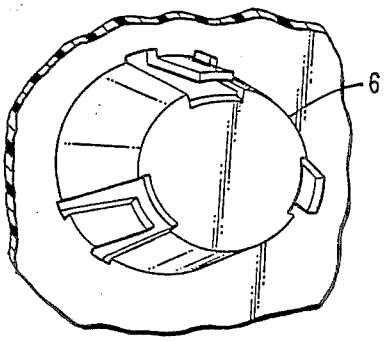
FIG. 3 is a detailed view of a tape roll holder according to the invention.

Referring to FIGS. 2 and 3 alternate embodiments of cutting edge assembly 24 and hub 6 are depicted, respectively.

Figure 4A:
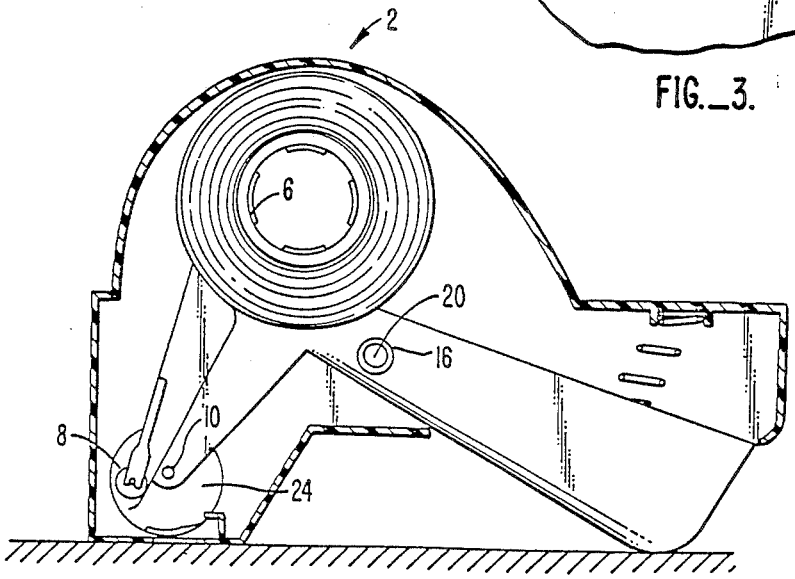
FIG. 4*a* is a sectional lateral view of a tape dispenser according to the invention showing the mechanism in the resting mode.
Figure 4B:
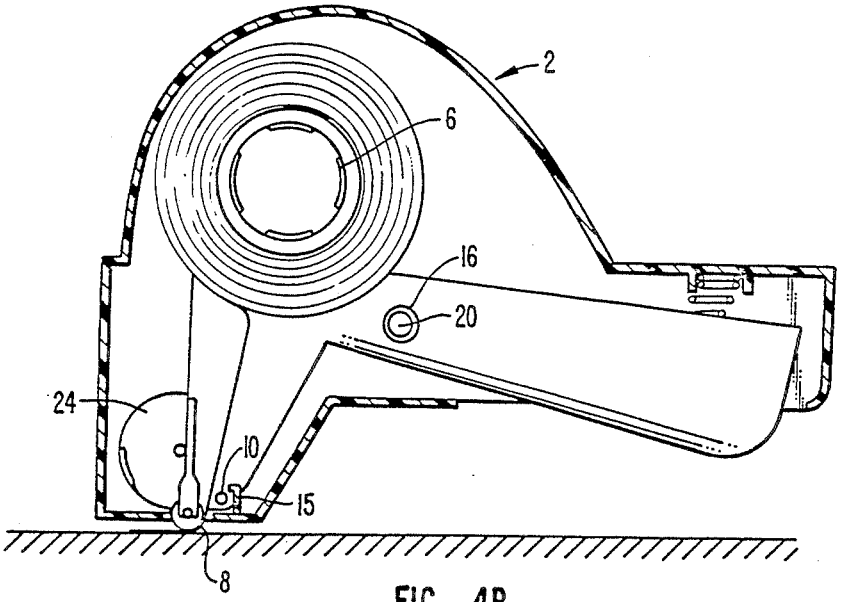
FIG. 4*b* is a sectional lateral view of a tape dispenser according to the invention showing the mechanism in the actuated mode.

Referring to FIGS. 4*a* and 4*b* the operation of the subject invention is depicted. In FIG. 4*a*, a dispenser according to the present invention is depicted in the resting mode wherein contact roller 8 is withdrawn into case 2 and cutting edge assembly 24 is covered by shield 15. In FIG. 4*b* trigger assembly 4 is actuated and contact roller 8 is disposed out from case 2 and cutting assembly 24 is withdrawn from shield 15. The release of the trigger assembly causes roller 8 to withdraw and brings the cutting edge assembly into shield 15, cutting the tape. Note that the travel of trigger assembly is limited by shield 15 such that roller 8 is prevented from jamming on case 2. Further, the operation of the roller is such that the angle of contact between the roller and the taping surface is not critical.

Figure 5:
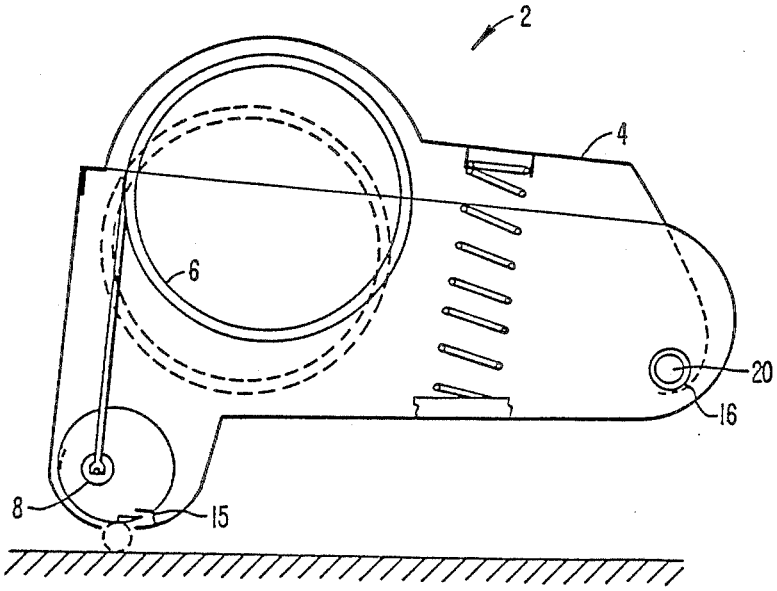
FIG. 5 is a sectional view of a alternate embodiment of a shield means according to the subject invention.
Figure 6:
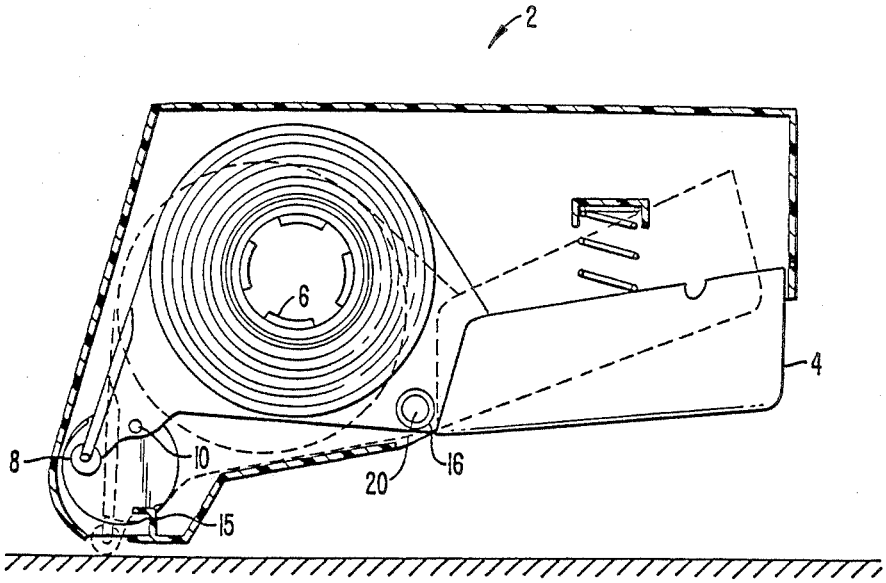
FIG. 6 is a sectional view of an alternate tape dispenser.
Figure 7:
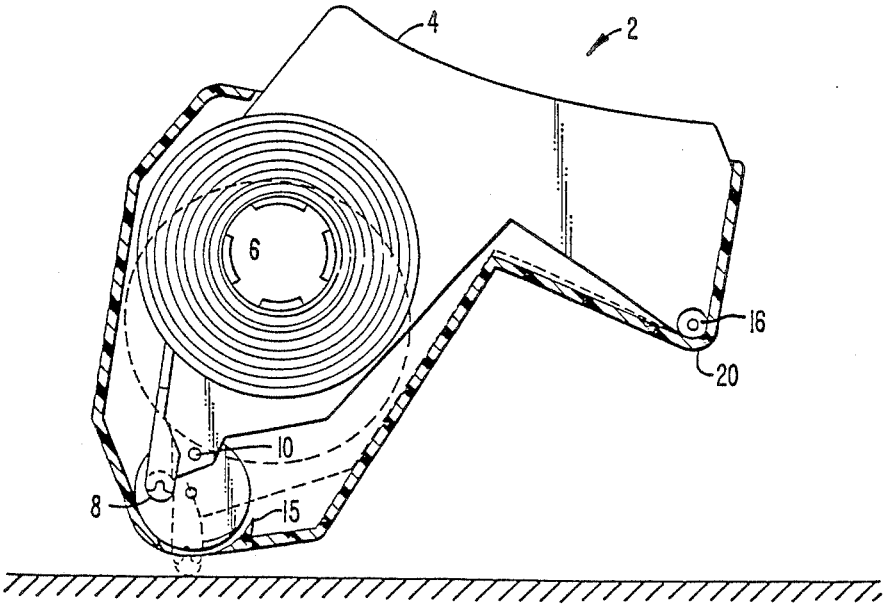
FIG. 7 is a sectional view of an alternate tape dispenser.

Referring to FIGS. 5, 6 and 7. alternate embodiments of the invention are provided having reference numbers corresponding to the above description.

The foregoing explanation is intended only to illustrate the invention and not to limit it. Those skilled in the art will appreciate that modifications of the invention may be practiced within the scope of the appended claims.

What is claimed is:

1. An improved tape dispenser of the type having a case surrounding a roll of tape to be dispensed, the case having a top and a bottom and including a bottom opening through which the tape is dispensed onto a surface and a trigger opening through which a pivotably mounted trigger assembly protrudes, a contact roller connected to the trigger assembly for dispensing the tape through the bottom opening when the trigger assembly is moved relative to the case, means for controlling the travel of the trigger assembly, and case-shielded means, coupled to the trigger assembly, for cutting the tape, the improvement comprising:

the trigger opening being formed in the bottom of the case;

the trigger assembly pivotably attached to the case at a pivot point substantially in the center of the trigger assembly, said trigger assembly including a downwardly protruding trigger portion extending through the trigger opening;

the bottom of the case and the trigger opening being spaced apart from the surface and defining an open area sufficient to admit a user's fingers between said trigger portion and the surface, with the top of the case against a user's palm;

whereby force is applied to the trigger mechanism from below and to the case from above by a user's hand to dispense tape through the bottom opening without requiring the case bottom to be in contact with the surface being taped.

2. The improvement of claim 1, wherein the bottom of the case adjacent the tape dispensing opening is not flat.

3. An improved tape dispenser of the type having a case surrounding a roll of tape to be dispensed, the case having a top and a bottom and including a tape opening in the bottom through which the tape is dispensed onto a surface and a trigger opening through which a trigger assembly, pivotably mounted within the case, protrudes, a contact roller connected to the trigger assembly for dispensing the tape througn the tape opening when the trigger assembly is moved within the case, means for controlling the travel of the trigger assembly, and case-shielded means, coupled to the trigger assembly, for cutting the tape, the improvement comprising;

the bottom of the case adjacent the tape dispensing opening being not flat;

the bottom of the case, other than the bottom of the case adjacent the tape dispensing opening, being spaced apart from the surface and defining an open area suficient to admit a user's fingers between said case bottom and the surface, with the top of the case facing toward a user's palm;

the trigger assembly including an upwardly protruding trigger;

the trigger opening being in the top of the case so said trigger protrudes through the trigger opening in said case and contacts a palm of a user's hand;

whereby force is applied to the trigger mechanism by a user's hand, allowing tape to be dispensed without requiring the case bottom to be in contact with the surface being taped, thereby allowing the dispenser to function over an increased angle with the surface being taped.

* * * * *